US009695718B2

(12) United States Patent
Kajikawa et al.

(10) Patent No.: US 9,695,718 B2
(45) Date of Patent: Jul. 4, 2017

(54) SILENCER

(71) Applicant: FUTABA INDUSTRIAL CO., LTD., Okazaki-shi, Aichi (JP)

(72) Inventors: Masahiro Kajikawa, Okazaki (JP); Kenji Yoshizawa, Okazaki (JP)

(73) Assignee: Futaba Industrial Co., Ltd., Okazaki-shi (JP)

( * ) Notice: Subject to any disclaimer, the term of this patent is extended or adjusted under 35 U.S.C. 154(b) by 0 days.

(21) Appl. No.: 15/307,168

(22) PCT Filed: Mar. 5, 2015

(86) PCT No.: PCT/JP2015/056521
§ 371 (c)(1),
(2) Date: Oct. 27, 2016

(87) PCT Pub. No.: WO2015/166707
PCT Pub. Date: Nov. 5, 2015

(65) Prior Publication Data

US 2017/0051646 A1 Feb. 23, 2017

(30) Foreign Application Priority Data

Apr. 28, 2014 (JP) ..... 2014-092921

(51) Int. Cl.
*F01N 1/08* (2006.01)
*F01N 1/16* (2006.01)
(Continued)

(52) U.S. Cl.
CPC ..... *F01N 1/083* (2013.01); *F01N 1/08* (2013.01); *G10K 11/161* (2013.01)

(58) Field of Classification Search
CPC ..... F16K 1/36; F16K 15/03; F16K 15/033; F16K 17/0413; F01N 1/08; F01N 1/085;
(Continued)

(56) References Cited

U.S. PATENT DOCUMENTS 4,609,068 A * 9/1986 Backlund ..... F01N 13/082 181/226
5,739,483 A * 4/1998 Yashiro ..... F01N 1/02 181/254
(Continued)

FOREIGN PATENT DOCUMENTS

EP 1445451 A2 8/2004
JP 3017964 B2 3/2000
(Continued)

OTHER PUBLICATIONS

Translation of Written Opinion of the International Search Authority (Form PCT/ISA/237) for International Application No. PCT/JP2015/056521, mailed May 26, 2015, 4 pages.
(Continued)

*Primary Examiner* — Edgardo San Martin
(74) *Attorney, Agent, or Firm* — Withrow & Terranova, P.L.L.C.; Vincent K. Gustafson

(57) ABSTRACT

A silencer comprises a casing, an inlet pipe for introducing an exhaust into the casing, and an outlet pipe for discharging the exhaust out of the casing. A lid is provided at an exhaust inflow side opening of the outlet pipe and arranged to close the exhaust inflow side opening. The lid has an exhaust inlet for flowing the exhaust into the outlet pipe, a valve body for opening and closing the exhaust inlet, and at least one communication hole formed separately from the exhaust inlet. The valve body is configured to be rotationally movable about a rotation axis of the valve body inside the outlet pipe. The at least one communication hole is provided closer to the rotation axis of the valve body than the exhaust inlet.

3 Claims, 7 Drawing Sheets

(51) Int. Cl.
*G10K 11/16* (2006.01)
*F01N 1/00* (2006.01)

(58) Field of Classification Search
CPC ..... F01N 1/163; F01N 1/165; F01N 1/166; F01N 2240/36; F01N 2290/10
USPC ..... 181/237, 241, 254; 60/324; 251/88; 137/527.6, 535
See application file for complete search history.

(56) References Cited

U.S. PATENT DOCUMENTS 6,065,564 A * 5/2000 Uegane ..... F01N 1/084 181/237
6,102,154 A 8/2000 Liu et al.
6,176,347 B1 1/2001 Chae et al.
6,546,722 B2 * 4/2003 Sagara ..... F01N 1/084 137/595
7,775,322 B2 * 8/2010 Hill ..... F01N 1/081 181/212
7,913,810 B2 * 3/2011 Meneely ..... F01N 1/02 181/237
8,056,673 B2 * 11/2011 Zelinski ..... F01N 13/004 181/227
8,657,065 B1 * 2/2014 Hill ..... F01N 1/165 181/237
8,939,141 B2 * 1/2015 Krueger ..... F16K 15/03 126/290
9,388,719 B2 * 7/2016 Kainuma ..... F01N 1/083
2004/0231323 A1 * 11/2004 Fujita ..... F01N 3/023 60/284
2008/0023264 A1 * 1/2008 Pacini ..... F01N 1/165 181/237
2008/0156578 A1 * 7/2008 Scotti ..... F01N 1/083 181/227
2009/0229911 A1 * 9/2009 Scotti ..... F01N 1/083 181/241

FOREIGN PATENT DOCUMENTS

JP 2000-240425 A 9/2000
JP 2002-070526 A 3/2002
JP 2005-147092 A 6/2005
WO WO 2016111326 A1 * 7/2016 ..... F01N 13/08

OTHER PUBLICATIONS

Notification of Transmittal of Translation of the International Preliminary Report on Patentability (Form PCT/IB/338) for International Application No. PCT/JP2015/056521, mailed Nov. 10, 2016, 1 page.
International Preliminary Report on Patentability (Form PCT/IB/373) for International Application No. PCT/JP2015/056521, dated Nov. 1, 2016, 1 page.
International Search Report (Form PCT/ISA/210) for International Application No. PCT/JP2015/056521, mailed May 26, 2015, 4 pages (including English translation).
Written Opinion (Form PCT/ISA/237) for International Application No. PCT/JP2015/056521, mailed May 26, 2015, 4 pages (including English machine translation of Box V).

* cited by examiner

SILENCER

CROSS-REFERENCE TO RELATED APPLICATIONS

This application is a 35 U.S.C. §371 national phase filing of International Application No. PCJ/JP2015/056521 filed on Mar. 5, 2015, and claims the benefit of Japanese Patent Application No. 2014-92921 filed on Apr. 28, 2014 in the Japan Patent Office. The entire disclosures of International Application No. PCT/JP2015/056521 and Japanese Patent Application No. 2014-92921 are hereby incorporated by reference herein in their respective entireties.

TECHNICAL FIELD

The present invention relates to a silencer.

BACKGROUND ART

Conventionally, a silencer for suppressing exhaust noise is known in an exhaust system of an internal combustion engine. The silencer, for example, comprises a casing, an inlet pipe for introducing an exhaust into the casing, and an outlet pipe for discharging the exhaust out of the casing. A valve body is provided at an opening on an exhaust inflow side of the outlet pipe, so as to open and close the opening.

Patent Document 1 discloses a silencer comprising a first exhaust outlet pipe (outlet pipe) and a second exhaust outlet pipe having a smaller diameter than the first exhaust outlet pipe, and the second exhaust outlet pipe is joined in the middle of the first exhaust outlet pipe. The silencer, when a rotation speed of an internal combustion engine is low and emissions are low, introduces the exhaust into the second exhaust outlet pipe having a smaller diameter, and discharges the exhaust from the second exhaust outlet pipe to an outside of the silencer through the first exhaust outlet pipe, thereby to improve silencing performance.

PRIOR ART DOCUMENTS

Patent Documents

Patent Document 1: Japanese Patent No. 3017964

SUMMARY OF THE INVENTION

Problems to be Solved by the Invention

The silencer as described in Patent Document 1, however, has the following problem. That is, when the rotation speed of the internal combustion engine is high and the emissions are high, the valve body of the first exhaust outlet pipe (outlet pipe) is opened, and the exhaust is introduced into the first exhaust outlet pipe from the opening on the exhaust inflow side. At this time, turbulence and/or stagnation of the exhaust occurs in a space on a back side of the opened valve body, thereby to decrease exhaust circulation and exhaust efficiency.

In one aspect of the present invention, it is desirable to provide a silencer with a simple structure that can improve exhaust circulation and is superior in exhaust silencing performance.

Means for Solving the Problems

A silencer according to one aspect of the present invention comprises a casing, an inlet pipe for introducing an exhaust into the casing, and an outlet pipe for discharging the exhaust out of the casing. At an exhaust inflow side opening of the outlet pipe, a lid for closing the exhaust inflow side opening is provided. The lid has an exhaust inlet for flowing the exhaust into the outlet pipe, a valve body that opens and closes the exhaust inflow side opening, and at least one communication hole formed separately from the exhaust inlet. The valve body is configured to be rotationally movable about a rotation axis of the valve body inside the outlet pipe. The at least one communication hole is provided closer to the rotation axis of the valve body than the exhaust inlet.

In the silencer described above, the exhaust inlet that can be opened and closed by the valve body is provided on the lid for closing the exhaust inflow side opening of the outlet pipe. Further, the lid is provided with the at least one communication hole separately from the exhaust inlet. The at least one communication hole is provided closer to the rotation axis of the valve body than the exhaust inlet. That is, the at least one communication hole is formed to communicate a space formed on a back side of the valve body inside the outlet pipe with an interior of the casing, when the valve body is rotationally moved about the rotation axis and is opened.

Therefore, for example, when a rotation speed and emissions of an internal combustion engine are high, and when the valve body at the lid of the outlet pipe is opened, the exhaust gas introduced into the casing from the inlet pipe is introduced into the outlet pipe not only from the exhaust inlet which is opened at the lid but also from the at least one communication hole. This makes it possible to flow the exhaust also into a back space of the valve body where turbulence and/or stagnation of the exhaust is likely to occur. As a result, turbulence and/or stagnation of the exhaust can be suppressed, circulation of the exhaust can be improved, and exhaust efficiency can be enhanced.

On the other hand, when the rotation speed and the emissions of the internal combustion engine are low, the valve body at the lid of the outlet pipe is closed. In this case, the exhaust introduced into the casing from the inlet pipe is introduced into the outlet pipe from the at least one communication hole in the lid. This reduces exhaust noise (exhaust energy) by expansion effect, and increases exhaust silencing performance. Conventionally, a small diameter exhaust pipe for silencing (e.g., second exhaust outlet pipe described in the above-described Patent Document 1) and the like has been provided separately from the outlet pipe. However, since sufficient silencing effect can be obtained without providing such an exhaust pipe for silencing, simplified structure can be achieved.

Thus, according to one aspect of the present invention, a silencer with a simple structure can be provided that can improve the flow of the exhaust and is excellent in exhaust silencing performance. That is, a silencer with a simple structure can be provided that is superior in both the exhaust circulation and the exhaust silencing performance.

In the silencer, at an exhaust inflow side end of the outlet pipe, a large diameter part may be provided which is enlarged in diameter than the other part of the outlet pipe. In this case, it is possible to increase an expansion ratio of capacitance between the at least one communication hole in the lid and the outlet pipe (large diameter part) to enhance exhaust noise (exhaust energy) reduction effect due to expansion effect. Thus, the exhaust silencing performance can be further improved.

Further, in the large diameter part of the outlet pipe, an enlarged diameter part may be provided which is formed to increases its diameter as it is closer to the exhaust inflow side opening. That is, the enlarged diameter part is formed such that its diameter is reduced on the farther side from the exhaust inflow side opening. In this case, reduction of a space can be achieved where turbulence and/or stagnation of the exhaust gas may occur in the large diameter part. Accordingly, turbulence and/or stagnation of the exhaust can be suppressed, and the circulation of the exhaust can be further improved.

EXPLANATION OF REFERENCE NUMERALS

Figure 1:
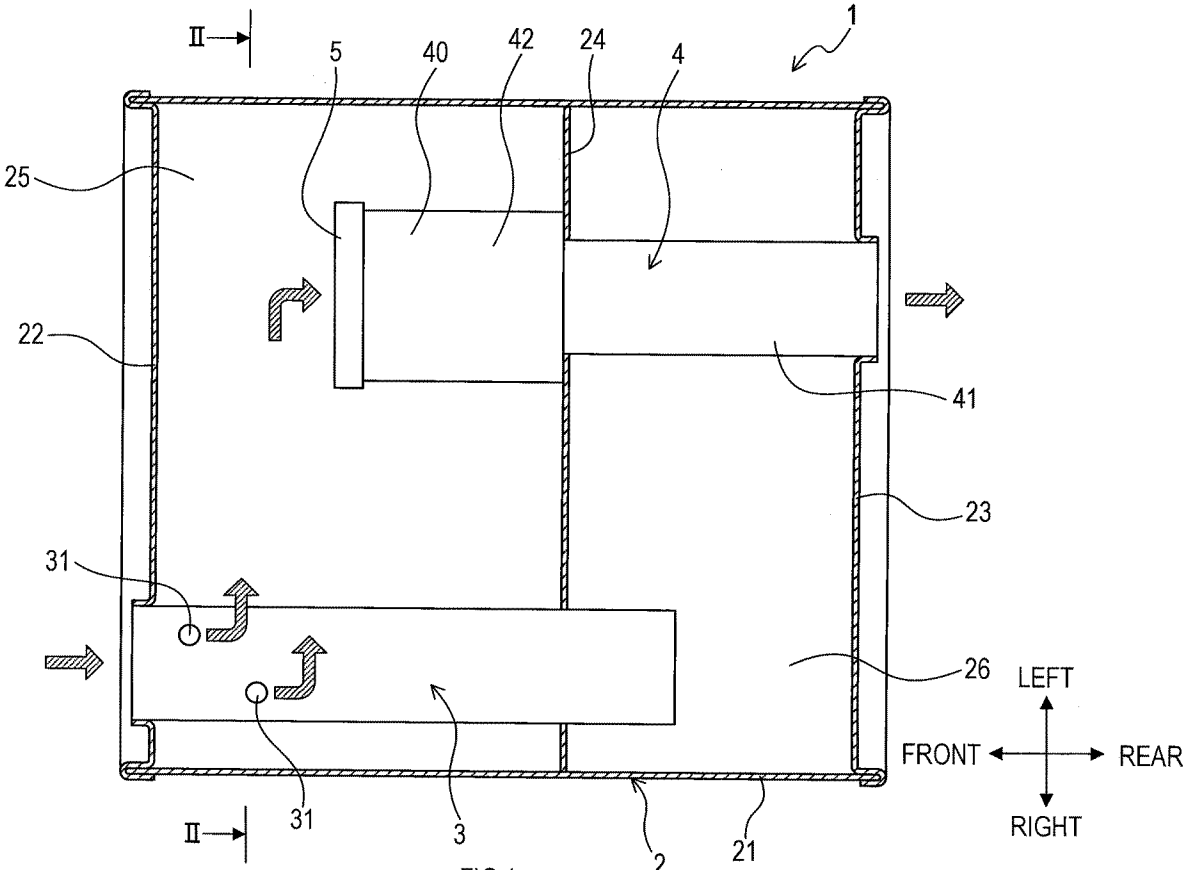
FIG. 1 is an explanatory view showing a structure of a silencer according to Embodiment 1.

1 . . . muffler
2 . . . casing
3 . . . inlet pipe
4 . . . outlet pipe
40 . . . exhaust inflow side opening
5 . . . lid
51 . . . exhaust inlet
52 . . . communication hole
62 . . . valve body
620 . . . rotation axis

MODE FOR CARRYING OUT THE INVENTION

Hereinafter, an embodiment of the present invention will be described with reference to the accompanying drawings.

In the drawings, indications of "up, down, front, rear, right and left" are only used for convenience. Unless otherwise noted, such indications are not intended for limitation of installation directions (directions with respect to a vehicle) of a silencer of the present invention.

[Embodiment 1]

As shown in FIGS. 1, 2, 3A, and 3B, a muffler (silencer) 1 of the present embodiment comprises a casing 2, an inlet pipe 3 for introducing an exhaust gas (exhaust) into the casing 2, and a outlet pipe 4 for discharging exhaust gas out of the casing 2. At an exhaust inflow side opening 400 of the outlet pipe 4, a lid 5 is provided that is arranged so as to close the exhaust inflow side opening 400.

The lid 5 comprises an exhaust inlet 51 for flowing the exhaust gas into the outlet pipe 4, a valve body 62 that opens and closes the exhaust inlet 51, and at least one communication hole 52 formed separately from the exhaust inlet 51. The valve body 62 is configured to be rotationally movable about a rotation axis 620 of the valve body 62 inside the outlet pipe 4. The at least one communication hole 52 is provided closer to the rotation axis 620 of the valve body 62 than the exhaust inlet 51. Hereinafter, the muffler 1 will be described in detail.

As shown in FIG. 1, the muffler 1 forms a part of an exhaust passage serving as a passage through which the exhaust gas is discharged from an engine (internal combustion engine) mounted on a vehicle. The muffler 1 comprises the casing 2. The casing 2 comprises a cylindrical tubular part 21 having an axially orthogonal elliptical cross section, and an upstream-side lid 22 and a downstream-side lid 23 for closing both end openings of the tubular part 21.

The casing 2 is partitioned into two chambers of a first chamber 25 (expansion chamber) and a second chamber 26 (resonance chamber) by a separator 24. The first chamber 25 is formed between the upstream-side lid 22 and the separator 24. The second chamber 26 is formed between the separator 24 and the downstream-side lid 23.

The muffler 1 comprises the inlet pipe 3 for introducing the exhaust gas from the engine into the casing 2. The inlet pipe 3 pierces through the upstream-side lid 22 and the separator 24. Further, the inlet pipe 3 opens its downstream end to the second chamber 26. In the first chamber 25, the inlet pipe 3 has a plurality of through holes 31 that communicates an interior space of the inlet pipe 3 with the first chamber 25.

The muffler 1 further comprises the outlet pipe 4 for discharging the exhaust gas introduced into the casing 2. The outlet pipe 4 pierces through the downstream-side lid 23 and the separator 24. Further, the outlet pipe 4 opens its upstream end (exhaust inflow side end 40) to the first chamber 25.

The outlet pipe 4 comprises a main body 41, and a large diameter part 42 having a larger diameter than the main body 41. The main body 41 has at least one drainage through hole (not shown) to improve drainage performance of condensed water. The at least one drainage through hole is open toward a lower side of the vehicle.

The large diameter part 42 is provided at the exhaust inflow side end 40 of the outlet pipe 4. In the outlet pipe 4, a part other than the large diameter part 42 is the main body 41. A center axis 420 of the large diameter part 42 is eccentric to an upper side of the vehicle with respect to a center axis 410 of the main body 41. That is, the center axis 410 of the main body 41 is eccentric to the lower side of the vehicle with respect to the center axis 420 of the large diameter part 42 (see FIG. 3A).

Figure 2:
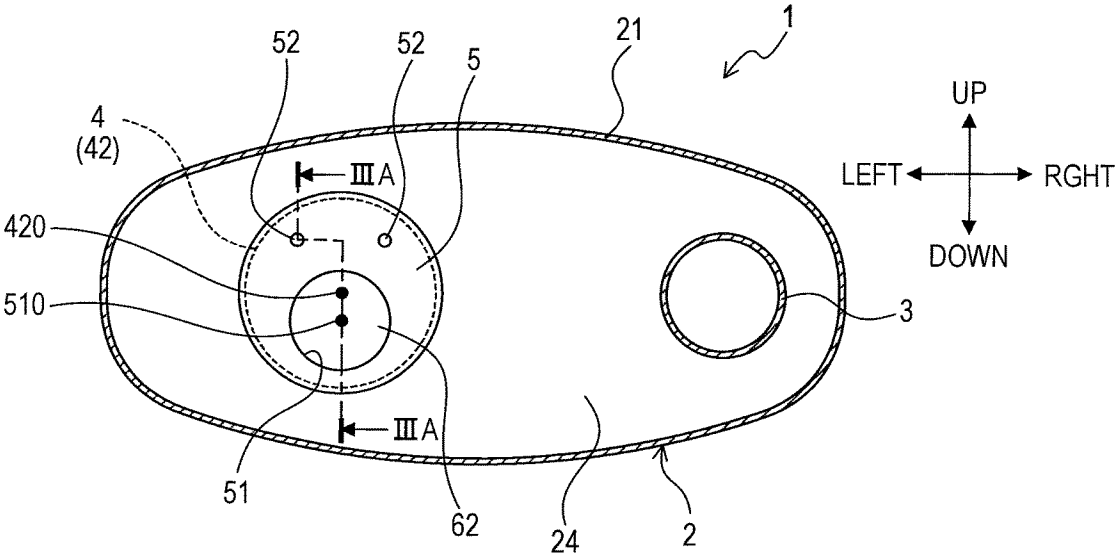
FIG. 2 is a cross-sectional view taken by a line II-II in FIG. 1.
Figure 3A:
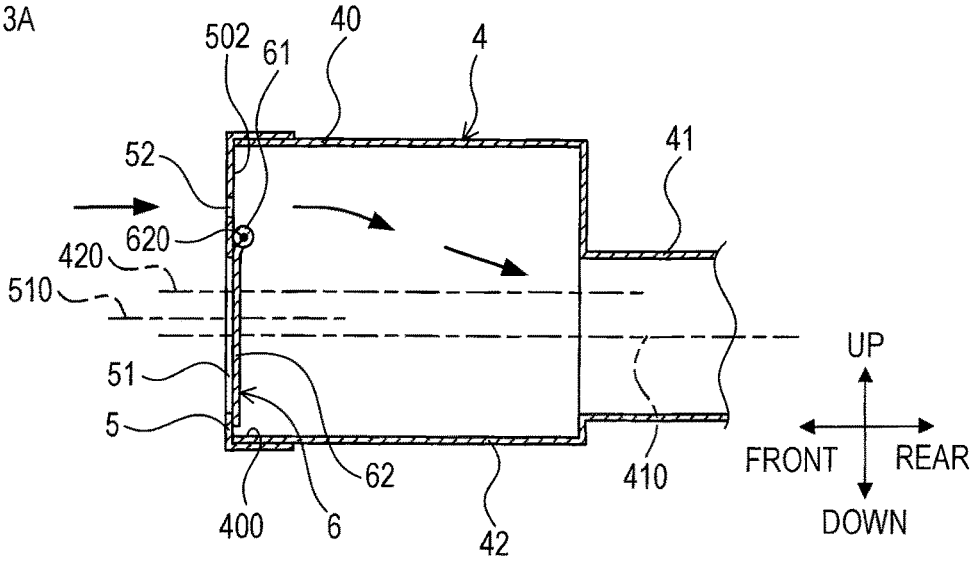
FIG. 3A is sectional view taken by a line IIIA-IIIA in FIG. 2, showing a closed state of a valve body.
Figure 3B:
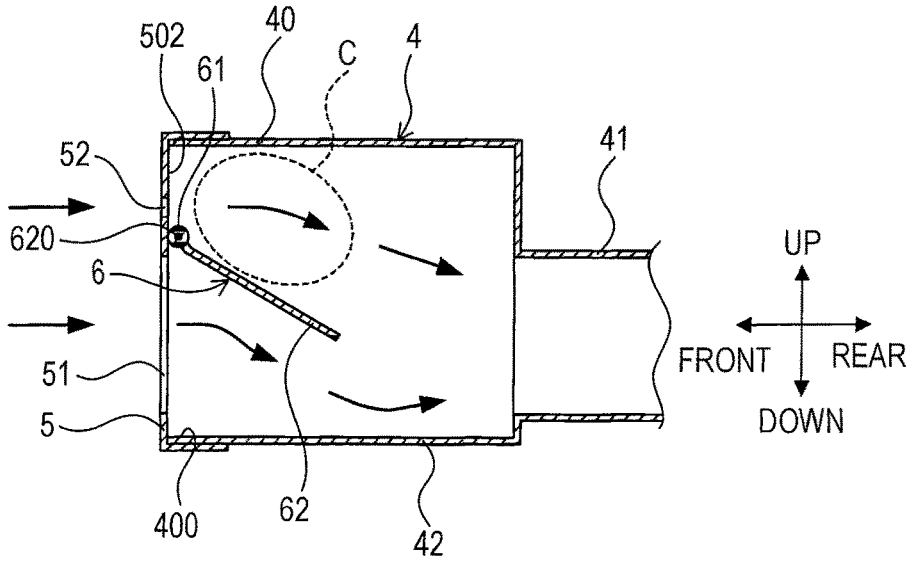
FIG. 3B is a sectional view showing an open state of the valve body.

As shown in FIGS. 2, 3A, and 3B, the exhaust inflow side opening 400 of the outlet pipe 4 is provided with the lid 5 arranged so as to close the exhaust inflow side opening 400. The lid 5 is joined to the exhaust inflow side end 40 of the outlet pipe 4. The lid 5 has the exhaust inlet 51 which communicates the first chamber 25 with an internal space of the outlet pipe 4. The exhaust inlet 51 is provided such that a center 510 of the exhaust inlet 51 is eccentric to the lower side of the vehicle with respect to the center axis 420 of the large diameter part 42.

A valve unit 6 is provided on a back surface 502 of the lid 5 (surface on the side of the internal space of the outlet pipe 4). The valve unit 6 has a rod-shaped rotation shaft 61 configured to be rotatable, and a plate-shaped valve body 62 joined to the rotation shaft 61. The rotation shaft 61 is provided above the exhaust inlet 51 in the vehicle. The valve body 62 is sized to cover the entire exhaust inlet 51 in the lid 5. Further, the valve body 62 is configured to be able to rotationally move the exhaust inlet 51 from a closed state to a direction of the inner space of the outlet pipe 4 (valve opening direction) about a center axis (rotation axis 620) of the rotation shaft 61, so as to open and close the exhaust inlet 51.

Further, the valve unit 6 has a biasing member (not shown) that biases the valve body 62 to a direction of the exhaust inlet 51 (closing direction) via the rotation shaft 61. A coil spring is used as the biasing member. A biasing force of the biasing member is configured such that the valve body 62 is not opened by a pressure of the exhaust gas and is closed (closed valve state, see FIG. 3A) when a rotation speed and emissions of the engine are low, and that the valve body 62 is opened by the pressure of the exhaust gas (open valve state, see FIG. 3B) when the rotation speed and emissions of the engine are high.

The lid 5 has two communication holes 52 for communicating the first chamber 25 with the interior space of the outlet pipe 4, separately from the exhaust inlet 51. The two communication holes 52 are provided closer to the rotation axis 620 of the valve body 62 than the exhaust inlet 51 in the lid 5. In the present embodiment, the two communication holes 52 are provided on the upper side of the vehicle than the rotation shaft 61 (rotation axis 620) in the lid 5. That is, the two communication holes 52 are provided on an opposite side to the exhaust inlet 51 relative to the rotation shaft 61 (rotation axis 620) in the lid 5. Furthermore, the two communication holes 52 are formed to have a smaller diameter than the exhaust inlet 51.

As shown in FIG. 1, in the muffler 1 having the above configuration, the exhaust gas (arrow in the figure) from the engine is introduced into the first chamber 25 in the casing 2 from the inlet pipe 3 via the plurality of through holes 31 formed in the inlet pipe 3, thereby to be silenced by expansion effect and/or resonance effect.

Here, as shown in FIG. 3A, when the rotation speed and the emissions of the engine are low, the valve body 62 is not opened by the biasing force of the biasing member due to low pressure of the exhaust gas, and the valve body 62 is closed (closed valve state). That is, the exhaust inlet 51 in the lid 5 of the outlet pipe 4 is in the closed state. In this case, the exhaust gas (arrow in FIG. 3A) introduced into the first chamber 25 is introduced from the two communication holes 52 in the lid 5 into the outlet pipe 4, and is discharged to an outside of the muffler 1.

On the other hand, as shown in FIG. 3B, when the rotation speed and the emissions of the engine are high, the valve body 62 is opened against the biasing force of the biasing member (open valve state) due to high pressure of the exhaust gas. That is, the exhaust inlet 51 in the lid 5 of the outlet pipe 4 is in an open state. In this case, the exhaust gas (arrow in FIG. 3B) introduced into the first chamber 25 is introduced from the exhaust inlet 51 and the two communication holes 52 in the lid 5 into the outlet pipe 4, and is discharged to the outside of the muffler 1.

Most of the exhaust gas introduced into the outlet pipe 4 comes from the exhaust inlet 51. The exhaust gas introduced from the exhaust inlet 51 flows through a space of the opened valve body 62 on the lower side of the vehicle. The exhaust gas introduced from the two communication holes 52 flows through the space of the opened valve body 62 on the upper side of the vehicle, i.e., space formed on the back side of the valve body 62 (back side space C).

Next, operation and effect of the present embodiment will be described.

In the muffler (silencer) 1 of the present embodiment, the lid 5 that closes the exhaust inflow side opening 400 of the outlet pipe 4 is provided with the exhaust inlet 51 which can be opened and closed by the valve body 62. Further, the lid 5, apart from the exhaust inlet 51, is provided with the two communication holes 52. The two communication holes 52 are provided closer to the rotation axis 620 of the valve body 62 than the exhaust inlet 51. That is, the two communication holes 52 are formed to communicate the space formed on the back side of the valve body 62 in the outlet pipe 4 (back side space C) with the interior of the casing 2 (first chamber 25), when the valve body 62 rotationally moves about the rotation axis 620 and is opened.

Therefore, as shown in FIG. 3B, when the rotation speed and the emissions of the engine are high, and when the valve body 62 in the lid 5 of the outlet pipe 4 is opened, the exhaust gas introduced from the inlet pipe 3 into the casing 2 (first chamber 25) is introduced into the outlet pipe 4 not only from the opened exhaust inlet 51 in the lid 5, but also from the two communication holes 52. Thus, the exhaust gas can flow also to the space on the back side of valve body 62 (back side space C) where turbulence and/or stagnation of the exhaust gas easily occurs. As a result, turbulence and/or stagnation of the exhaust gas can be suppressed, the circulation of the exhaust gas can be improved, and the exhaust efficiency can be enhanced.

On the other hand, as shown in FIG. 3A, when the rotation speed and the emissions of the engine are low, the valve body 62 in the lid 5 of the outlet pipe 4 is closed. In this case, the exhaust gas introduced from the inlet pipe 3 to the casing 2 (first chamber 25) is introduced from the two communication holes 52 in the lid 5 into the outlet pipe 4. This reduces the exhaust noise (exhaust energy) by expansion effect, and enhances the exhaust silencing performance. Conventionally, a small-diameter exhaust pipe for silencing is provided separately from the outlet pipe 4 (for example, second exhaust outlet pipe described in the Patent Document 1 described above). Since sufficient silencing effect can be obtained without providing such an exhaust pipe for silencing or the like, simplification in structure can be achieved.

In the present embodiment, the exhaust inflow side end 40 of the outlet pipe 4 is provided with the large diameter part 42 having a larger diameter than the other part (main body 41 in the present embodiment) of the outlet pipe 4. Therefore, an expansion ratio of capacitance between the two communication holes 52 in the lid 5 and the outlet pipe 4 (large diameter part 42) can be increased to enhance exhaust noise (exhaust energy) reduction by expansion effect. Thus, further improvement in the exhaust silencing performance can be achieved.

In the outlet pipe 4, the center axis 410 of the main body 41 is eccentric to the lower side of the vehicle with respect to the center axis 420 of the large diameter part 42. The exhaust inlet 51 in the lid 5 is provided such that a center axis 510 of the exhaust inlet 51 is eccentric to the lower side of the vehicle with respect to the center axis 420 of the large diameter part 42. That is, the center axis 410 of the main body 41 and the center axis 510 of the exhaust inlet 51 in the lid 5 are eccentric to the same direction with respect to the center axis 420 of the large diameter part 42. Therefore, when the valve body 62 in the lid 5 is in the open state, the circulation of the exhaust gas introduced from the exhaust inlet 51 into the outlet pipe 4 to flow from the large diameter part 42 to the main body 41 can be improved.

As noted above, according to the present embodiment, the muffler (silencer) 1 with a simple structure can be provided that can improve the circulation of the exhaust gas (exhaust) and is excellent in the exhaust silencing performance. That is, the muffler (silencer) 1 with a simple structure is provided that achieves both the exhaust circulation and the exhaust silencing performance.

[Embodiment 2]

Figure 4:
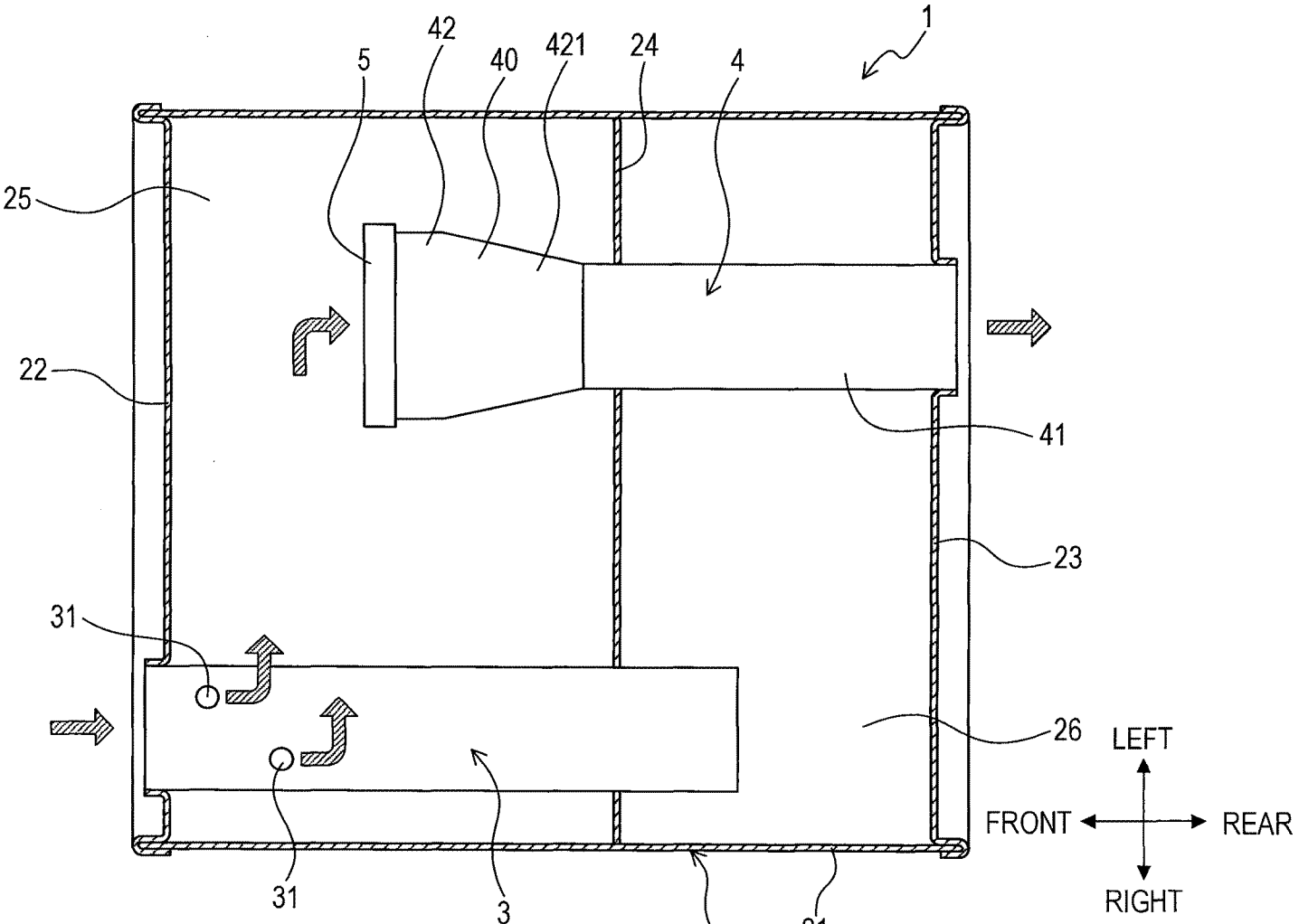
FIG. 4 is an explanatory view showing a structure of a silencer according to Embodiment 2.
Figure 5A:
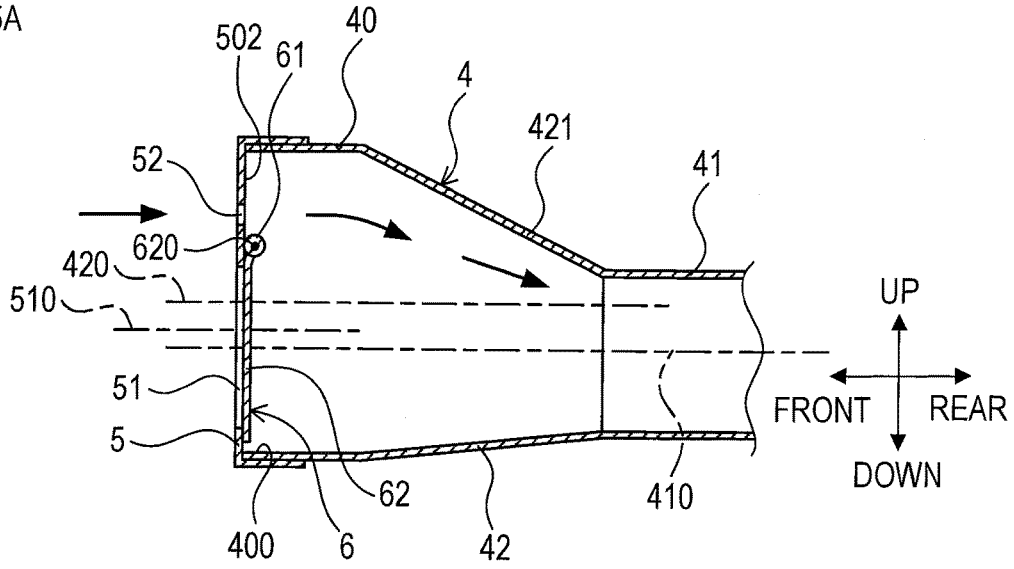
FIG. 5A is a sectional view showing the closed state of the valve body.
Figure 5B:
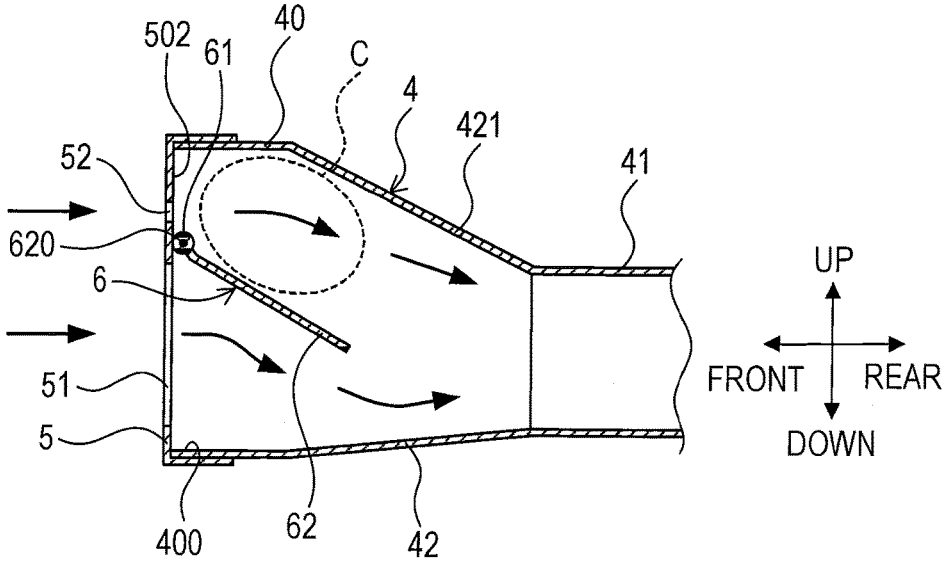
FIG. 5B is a sectional view showing the open state of the valve body.

The present embodiment, as shown in FIGS. 4, 5A, and 5B, is an example in which the configuration of the outlet pipe 4 in the muffler (silencer) 1 is altered. FIG. 5A is a sectional view similar to FIG. 3A. FIG. 5B is a sectional view similar to FIG. 3B. FIG. 5A is a view showing the valve body 62 in the closed state. FIG. 5B is a view showing the valve body 62 in the open state.

As shown in the figures, the large diameter part 42 of the outlet pipe 4 is provided with an enlarged diameter part 421 formed to increase its diameter as it is closer to the exhaust inflow side opening 400. That is, the enlarged diameter part 421 is formed to decrease its diameter as it is farther from the exhaust inflow side opening 400 (as it is closer to the main body 41). Other basic configuration is the same as that of the Embodiment 1.

In the present embodiment, the large diameter part 42 of the outlet pipe 4 is provided with the enlarged diameter part 421 which is formed to increase its diameter as it is closer to the exhaust inflow side opening 400. Therefore, reduction of a space is achieved where turbulence and/or stagnation of the exhaust gas may occur in the large diameter part 42. Accordingly, turbulence and/or stagnation of the exhaust gas can be suppressed, and the circulation of the exhaust gas can be further improved. Other basic operation and effect are the same as those in the Embodiment 1.

[Embodiment 3]

Figure 6:
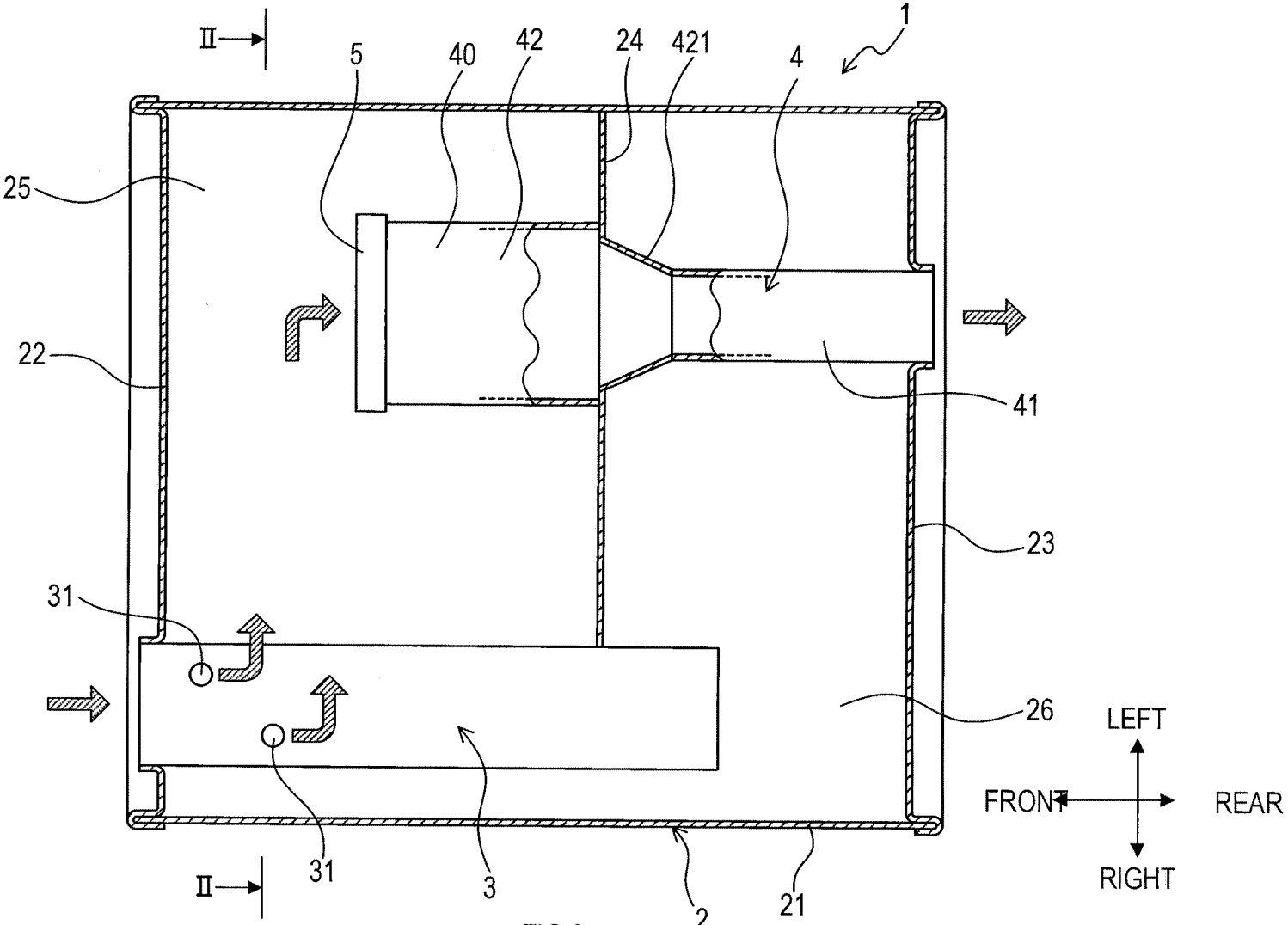
FIG. 6 is an explanatory view showing a structure of a silencer according to Embodiment 3.
Figure 7A:
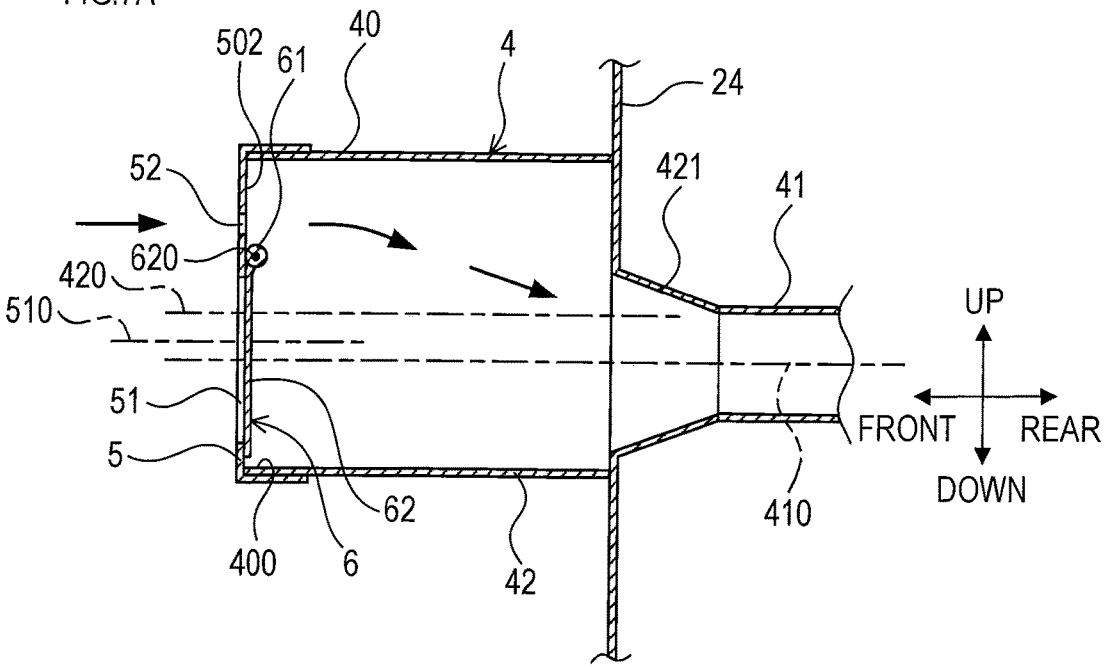
FIG. 7A is a sectional view showing the closed state of the valve body.
Figure 7B:
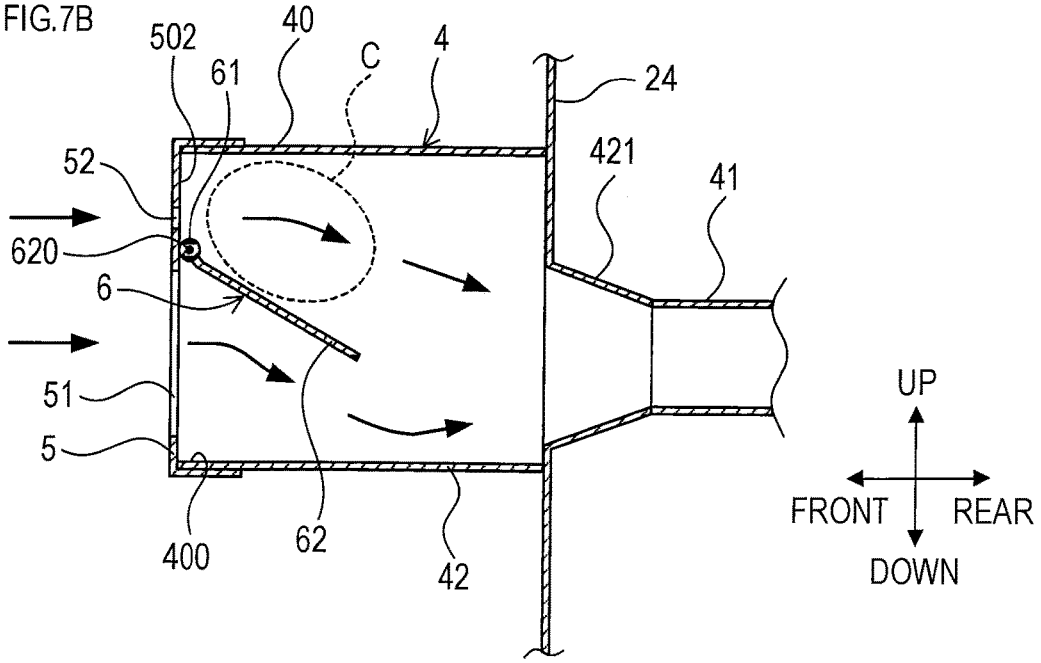
FIG. 7B is a sectional view showing the open state of the valve body.

The present embodiment, as shown in FIGS. 6, 7A, and 7B, is an example in which the configuration of the outlet pipe 4 in the muffler (silencer) 1 is altered. FIG. 7A is a cross-sectional view similar to FIG. 3A, with illustration of the separator 24. FIG. 7B is a cross-sectional view similar to FIG. 3B, with illustration of the separator 24. FIG. 7A shows the valve body 62 in the closed state. FIG. 7B shows the valve body 62 in the open state.

As shown in the figures, the large diameter part 42 of the outlet pipe 4 is provided with the enlarged diameter part 421. The enlarged diameter part 421 is configured by a part of the separator 24. More specifically, the enlarged diameter part 421 is configured by a part of the separator 24 protruding toward the main body 41 of the outlet pipe 4. The enlarged diameter part 421 is formed to decreases its diameter as it is closer to the main body 41. Other basic configuration is the same as that of the Embodiment 2. Further, the basic function and effect are also the same as those of the Embodiment 2.

[Other Embodiments]

It goes without saying that the present invention is not in any way limited to the embodiments described above, and may be practiced in various forms within the scope not departing from the present invention.

(1) In the above embodiments, the interior of the muffler casing is partitioned into two chambers of the first chamber and the second chamber by the separator, but may be partitioned into three or more chambers by a plurality of separators, for example.

(2) In the above embodiments, the communication hole in the lid of the outlet pipe is provided closer to the rotation axis of the valve body than the exhaust inlet. That is, the communication hole may be provided at a part other than the exhaust inlet, and also at a position to communicate the space formed on the back side of the valve body (back space) in the outlet pipe and the casing (position where the exhaust flows to the back side space through the communication hole) when the valve body is in the open state, in the lid. For example, the communication holes may be provided closer to the rotation axis of the valve body than the center axis of the circular exhaust inlet, in the lid. Further, when there is a plurality of the communication holes, at least one communication hole may be provided closer to the rotation axis of the valve body than the exhaust inlet in the lid, and the other communication holes may be provided in the other part of the lid.

(3) In the above embodiments, the lid of the outlet pipe has two communication holes. There may be, for example, one or may be three or more communication holes. Further, the position to form the communication hole can be variously changed within a range where the effects of the present invention are exerted.

(4) In the above embodiments, the outlet pipe is not provided with an exhaust pipe for silencing and the like which has a smaller diameter than the outlet pipe and is joined in the middle of the outlet pipe, as in the prior art. Such an exhaust pipe for silencing or the like may exist.

The invention claimed is:

1. A silencer comprising:

a casing;

an inlet pipe for introducing an exhaust into the casing; and an outlet pipe for discharging the exhaust out of the casing, a lid being provided at an exhaust inflow side opening of the outlet pipe, and arranged to close the exhaust inflow side opening, the lid comprising an exhaust inlet for flowing the exhaust into the outlet pipe, a valve body for opening and closing the exhaust inlet, and at least one communication hole formed separately from the exhaust inlet, the valve body being configured to be rotationally movable about a rotation axis of the valve body inside the outlet pipe, and the at least one communication hole being provided closer to the rotation axis of the valve body than the exhaust inlet.

2. The silencer according to claim 1, wherein an exhaust inflow side end of the outlet pipe includes a large diameter part which has a larger diameter than a remainder of the outlet pipe.

3. The silencer according to claim 2, wherein the large diameter part of the outlet pipe includes an enlarged diameter part which increases in diameter as the enlarged diameter part is closer to the exhaust inflow side opening.

* * * * *